US008323125B2

(12) United States Patent
Bowen

(10) Patent No.: US 8,323,125 B2
(45) Date of Patent: Dec. 4, 2012

(54) MULTILEGGED TEE

(76) Inventor: Glen Bowen, Kingwood, TX (US)

( * ) Notice: Subject to any disclaimer, the term of this patent is extended or adjusted under 35 U.S.C. 154(b) by 34 days.

(21) Appl. No.: 12/899,161

(22) Filed: Oct. 6, 2010

(65) Prior Publication Data

US 2012/0088609 A1 Apr. 12, 2012

(51) Int. Cl.
*A63B 57/00* (2006.01)

(52) U.S. Cl. ..... 473/387

(58) Field of Classification Search ..... 473/387–403; D21/717

See application file for complete search history.

(56) References Cited

U.S. PATENT DOCUMENTS

| | | | | | |
|---|---|---|---|---|---|
| 567,455 | A | | 9/1895 | Dalziel | |
| 638,920 | A | | 7/1899 | Grant | |
| 1,650,141 | A | | 8/1925 | Lowell | |
| D70,800 | S | * | 8/1926 | McDonald | D21/386 |
| 1,623,782 | A | * | 4/1927 | Dent et al. | 473/392 |
| 1,658,226 | A | * | 2/1928 | Clausing | 473/390 |
| 1,671,630 | A | * | 5/1928 | Duganne | 473/395 |
| 1,692,191 | A | * | 11/1928 | Towsley | 473/400 |
| D78,530 | S | * | 5/1929 | McLeod | D21/717 |
| 2,074,519 | A | * | 3/1937 | Shephard | 473/402 |
| 2,160,122 | A | * | 5/1939 | Bundy | 473/397 |
| 2,555,222 | A | * | 5/1951 | Coleman et al. | 473/390 |
| D172,327 | S | * | 6/1954 | Ankney | D21/717 |
| 2,786,683 | A | | 3/1957 | Shapiro | |
| D195,087 | S | * | 4/1963 | Eyer | D21/717 |
| 3,141,671 | A | * | 7/1964 | Eyer | 473/390 |
| D202,359 | S | * | 9/1965 | Harris | D21/717 |
| D204,389 | S | * | 4/1966 | Rhame | D6/466 |
| D214,798 | S | * | 7/1969 | Court | D6/498 |
| 3,690,676 | A | | 9/1972 | Costa | |
| 5,052,689 | A | | 10/1991 | Lettrich | |
| 5,193,803 | A | | 3/1993 | Flick | |
| 5,310,189 | A | * | 5/1994 | Soto | 473/219 |
| 5,403,006 | A | * | 4/1995 | Korte-Jungermann | 473/284 |
| 5,571,055 | A | * | 11/1996 | Lewis et al. | 473/398 |
| 6,152,837 | A | * | 11/2000 | Reid | 473/387 |
| D485,317 | S | | 1/2004 | Cardarelli | |
| 6,887,169 | B2 | | 5/2005 | Whitehill et al. | |
| D533,241 | S | * | 12/2006 | Calhoon et al. | D21/717 |
| D542,366 | S | * | 5/2007 | Iacono et al. | D21/717 |
| D576,236 | S | * | 9/2008 | Kelley | D21/717 |
| 7,448,967 | B1 | * | 11/2008 | Panneri et al. | 473/387 |
| 7,468,008 | B2 | * | 12/2008 | Shin | 473/400 |
| D602,543 | S | * | 10/2009 | Simazaki | D21/717 |
| D641,813 | S | * | 7/2011 | Bowen | D21/717 |

OTHER PUBLICATIONS

Anonymous; Who invented The Golf Tee?; Online Article; Feb. 24, 2010; http://www.volusiacountyschools.net/wwww33.brinkster.com/iiiii/inventions/tee.asp.htm. Ellis, P.; An Improved Golf Tee; Provisional Specification; No. 3916; Feb. 29, 1892; Darling & Son, Ltd.; London.

Matthews, P.M.; An Inprovement in Golf Tees; Provisional Specification; No. 14,292; Jun. 12, 1897; Johnson's Petitioner's Agents; Glasgow, UK.

* cited by examiner

*Primary Examiner* — Steven Wong
(74) *Attorney, Agent, or Firm* — Robert C. Rolnik

(57) ABSTRACT

A tee for use with a golf ball. It includes a first leg, a second leg, and a third leg, joined at a hub, each leg having an end that is coplanar to form a terrain plane with the ends of corresponding legs. It also has a first ball support; a second ball support; and a third ball support, extending from the hub, wherein each ball support has an end that is coplanar to the ends of the corresponding ball supports in a ball support plane The ball support plane may be within a few degrees of parallel to the terrain plane.

10 Claims, 3 Drawing Sheets

MULTILEGGED TEE

CROSS-REFERENCE TO RELATED APPLICATIONS

This patent application claims the benefit to U.S. patent application Ser. Nos. 29/367,979 and 29/367,992 filed on Aug. 16, 2010, hereby incorporated by reference in their entirety.

BACKGROUND OF THE INVENTION

1. Field of the Invention

The present invention relates generally to a tee. More specifically, the present invention relates to a golf tee having legs for stabilization.

2. Description of the Related Art

A golfer, who plays in many seasons, can find himself on a golf course that has varying turf conditions. In addition, golfers may practice hitting golf balls with clubs in informal settings, for example when practicing in a back yard using small plastic balls instead of a regulation golf ball, such as WIFFLE® balls. Wiffle is a trademark of The Wiffle Ball, Inc. In some situations, the use of a conventional tee may fail to produce an upright tee with a stable surface on which to place a golf ball or practice ball.

Winds can also be a factor in ball stability when placed on a tee. In addition, firm soils can pose challenges to a golfer who wishes to place a ball on a tee above the turf.

The first known tee to penetrate the ground was the "Perfectum" tee, for which British provisional specification no. 3916 was filed in 1892 by P. Ellis. Ellis discloses a rubber circle with a metal spike that is pushed into the ground. A variation of this, the "Victor" tee, consists of a cup-shaped rubber top, which connects to a ground spike, as disclosed in British provisional specification no. 14,292 by P. M. Matthews dated 1897.

U.S. Pat. No. 567,455 was issued to David Dalziel on Sep. 8, 1896. The patent consists of a rubber tee with a flat base and slightly concave top, in combination with an artificial ground surface.

U.S. Pat. No. 638,920, to Dr. George F. Grant, discloses a peg with a rubber top that is pushed into the ground. Although resembling a modern tee, the invention failed to disclose a concave head.

The "Reddy Tee" is described in U.S. Pat. No. 1,650,141 to William Lovell. First manufactured in wood and painted with red tops so they could be seen easily, they were soon produced in a variety of styles and materials. Although plastic tees are available, simple wooden tees similar to those made in the 1920's are still the most common type.

Although many ways to support a ball have been developed, golfers continue to experience difficulty with conventional tees. In addition to wind and soil issues, noted above, some golfers may require assistance setting a conventional tee in a vertical manner such that the upper cup portion of the tee can support a golf ball.

Accordingly, a suitable tee or ball support is desirable that addresses these concerns.

SUMMARY OF THE INVENTION

The present invention provides a tee for use with a golf ball. It includes a first leg, a second leg, and a third leg, joined at a hub, each leg having an end that is coplanar to form a terrain plane with the ends of corresponding legs. It also has a first ball support; a second ball support; and a third ball support, extending from the hub, wherein each ball support has an end that is coplanar to the ends of the corresponding ball supports in a ball support plane. The ball support plane may be within a few degrees of parallel to the terrain plane.

A further embodiment may be a tee comprising a spike for use penetrating turf having an end that extends to a spike length, supported by at least two angled legs that extend from a hub down to a level above a spike end. In addition, the tee may have a first ball support, a second ball support and a third ball support, extending upward from the hub, wherein each ball support is less than 80% the length of a golf-ball radius.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 3 is a cutaway view illustrating a relationship between planes defined by a tripodal tee in accordance with an illustrative embodiment of the invention;

DETAILED DESCRIPTION OF THE PREFERRED EMBODIMENT

Figure 1A:
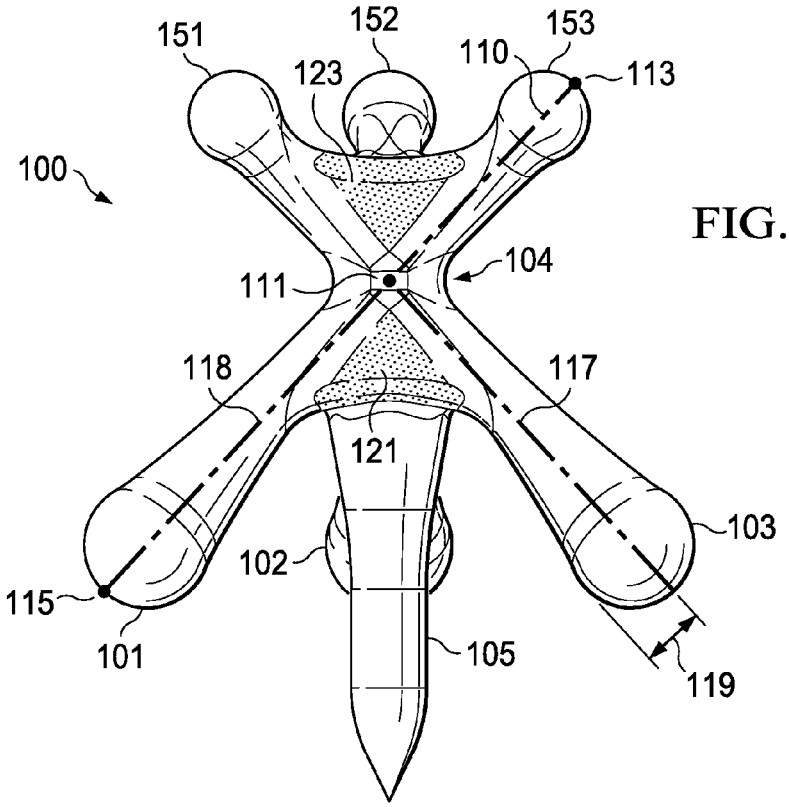
FIG. 1A is a side-view of a tripodal tee having a central spike in accordance with an illustrative embodiment of the invention.

With reference now to the figures and in particular with reference to FIG. 1A, there is shown a side-view of a tripodal tee having a central spike in accordance with an illustrative embodiment of the invention. Tee 100 includes three legs, 101, 102, 103 that join together at hub 104. Above hub 104, extend three ball supports 151, 152, 153 that project upwardly and outwardly from the hub. Each leg extends along an axis, such as, for example, axis 118. The axis may be a line that extends from central point 111 to an end 115 or tip of the leg. Similarly, each ball support, for example 153 extends from central point 111 to support end 113 along axis 110.

The dimensions of the legs and ball supports are made to enhance ball stability and make the tee portable. For example, ball supports can be 80% or less of a golf ball radius. Typical golf ball radii are 42.6 mm plus or minus 0.4 mm. Accordingly, ball support distance from central point 111 to ball support end 113 can be 17 mm or shorter. Further, the first ball support can extend along an axis. In a similar manner, the second ball support extends along a second axis, and the third ball support extends along a third axis such that each axis is at least 80 degrees angled from other axes of the other ball supports.

Each of the ball supports and/or legs may have blunt ends. By blunt, it is meant a roughly spherical end that has a radius of at least 2.0 mm, for example radius 119. It is appreciated that flat ends, pointed ends, clawed ends, or any combination of these ends may be used in the legs or in the ball supports in alternative embodiments.

For added stability in soil, the tee may have spike 105 extending from hub 104. The spike may extend below a terrain plane formed by the ends of legs 101, 102, and 103. A terrain plane is the plane that the ends of the legs touch, at least by some portion of each leg's blunt contour. An alternative embodiment, instead of a spike extending from a hub, may have a spike extending from a leg. In each case, the spike extends from at least one leg in a direction normal to the terrain plane.

To strengthen tee 100, a web of resilient material may be between each leg so that adjacent legs have a web between them. For example, legs 101 and 103 have web 121 extending between them. Additional webs may be between leg 101 and 102, as well as between legs 102 and 103. Similarly, a web of resilient material may extend between ball supports. Thus, ball supports 151 and 153 have web 123 extending between them. Additional webs may be between ball supports 151 and 152, as well as between ball supports 152 and 153.

Figure 1B:
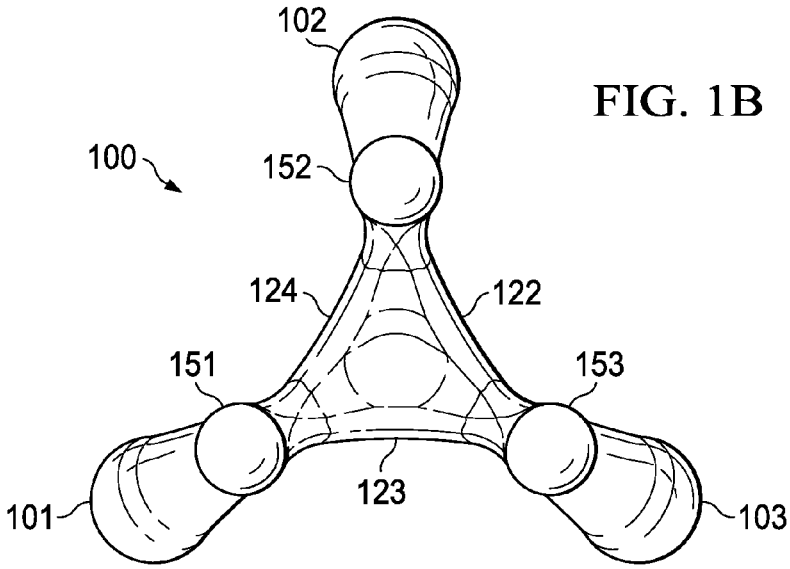
FIG. 1B is a top-view of a tripodal tee having a central spike in accordance with an illustrative embodiment of the invention.

FIG. 1B is a top-view of a tripodal tee having a central spike in accordance with an illustrative embodiment of the invention. There is shown web 123 between ball supports 151 and 153, as well as web 124 between ball supports 151 and 152, and web 122 between ball supports 152 and 153.

It is appreciated that tee 100 may have more or less legs than three. If fewer than three legs are present, then at least one leg end and the plane having a surface normal along the spike axis, forms the terrain plane. The spike can be used for penetrating turf, soil or any other loose surface. Referring again to FIG. 1A, spike 105 has a spike length from central point 111 to the end of the spike long enough to penetrate most turf conditions. Accordingly, a spike end is below the terrain plane, when used to penetrate turf.

Figure 2:
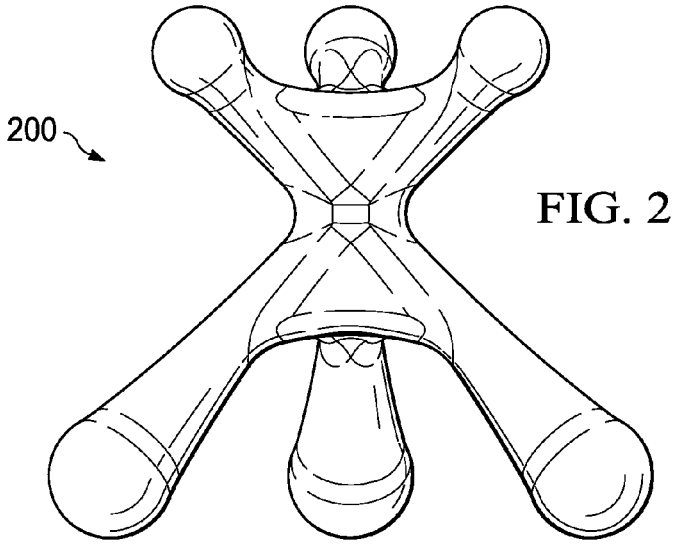
FIG. 2 is a side view of a tripodal tee in accordance with an illustrative embodiment of the invention.

FIG. 2 is a side view of a tripodal tee in accordance with an illustrative embodiment of the invention. Tee 200 may have the same features as tee 100 in FIG. 1A, except that a spike is not present in tee 200.

FIG. 3 is a cutaway view illustrating a relationship between planes defined by a tripodal tee in accordance with an illustrative embodiment of the invention. Ball support plane 301 is formed by three ends of the ball supports 151, 152, and 153. Terrain plane 302 is formed by the three ends of the legs 101, 102 and 103. The tolerance of the ball supports and legs is such that the ball support plane and the leg support plane may be either parallel or slightly non-parallel. If non-parallel, ball support plane 301 and leg support plane 302 may meet at an angle less than 10 degrees.

Figure 4:
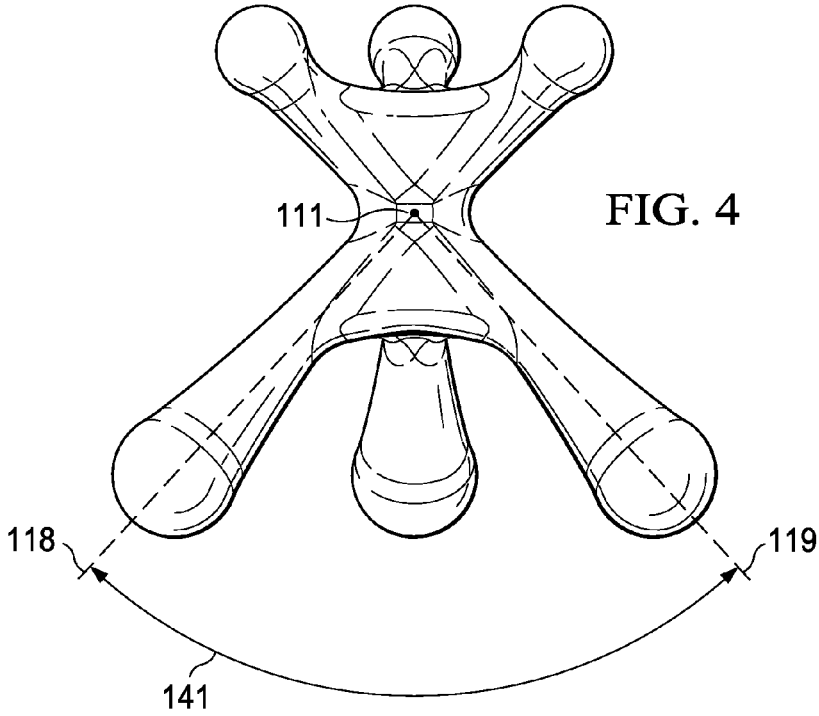
FIG. 4 is a side-view of a tripodal tee in accordance with an illustrative embodiment of the invention.
Figure 5:
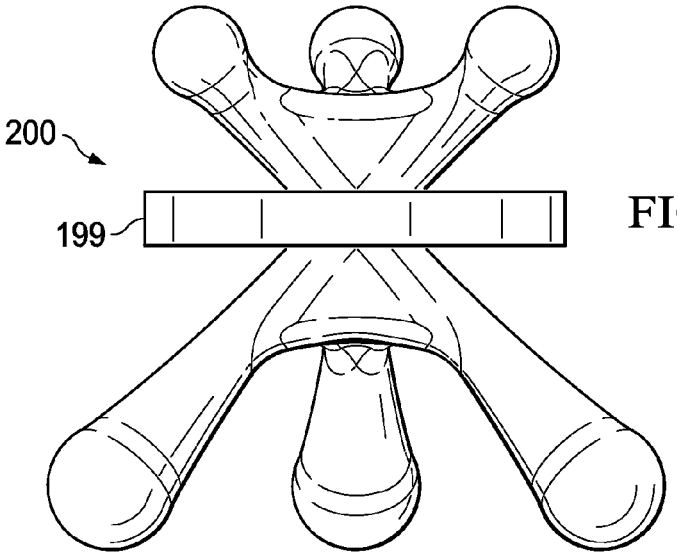
FIG. 5 is a side-view of a tripodal tee in accordance with an illustrative embodiment of the invention.

FIG. 4 is a side-view of a tripodal tee in accordance with an illustrative embodiment of the invention. Axes 118 and 119 may have an angle 141 formed at the central point 111 that is 30 degrees or more. The axes may have angles of less than 140 degrees. FIG. 5 is a side-view of a tripodal tee in accordance with an illustrative embodiment of the invention. Tripodal tee can include disk or annular ring 199 extending from central point 111.

In addition, the ball supports may be along axes 118 and 119. As such, the angle between the ball supports may be narrower than 90 degrees. Variations in height of a supported ball may be made by varying the lengths of tee legs and ball supports. In addition, the angles between pairs of legs or pairs of ball supports may be made narrower or broader.

It is appreciated that additional features may be placed at or around the hub in either of the exemplary embodiments to form alternative embodiments. For example, in alternative embodiments a disk or annular ring may extend horizontally from the hub. In such a configuration, the disk may absorb some impact from a club face so that the legs and ball supports may be deflected less by the overall collision of club to tee.

By carrying multiple tees in varying leg length, ball support length and/or angles between legs or ball supports, a golfer may have several options for setting a ball height when playing a ball. In addition, using resilient material, the tee can be made more durable than conventional tees.

The description of the present invention has been presented for purposes of illustration and description, and is not intended to be exhaustive or limited to the invention in the form disclosed. Many modifications and variations will be apparent to those of ordinary skill in the art. The embodiments were chosen and described in order to best explain the principles of the invention, the practical application, and to enable others of ordinary skill in the art to understand the invention for various embodiments with various modifications as are suited to the particular use contemplated.

What is claimed is:

1. A tee for use with a golf ball, comprising:

a first leg, a second leg, and a third leg, joined at a hub, each leg having a blunt end that is coplanar to form a terrain plane with the ends of corresponding legs, wherein the first leg and the second leg are separated by at least 30 degrees the second leg and the third leg are separated by at least 30 degrees and the third leg and the first leg are separated by at least 30 degrees, and a spike extends from at least one leg in a direction normal to the terrain plane; and a first ball support, a second ball support, and a third ball support, extending from the hub, wherein each ball support has an end that is coplanar to the ends of the corresponding ball supports in a ball support plane, and wherein the ball support plane is within a few degrees of parallel to the terrain plane.

2. The tee of claim 1, wherein each end of each ball support is blunt.

3. The tee of claim 1, further comprising:

a first web of resilient material extending between the first leg and the second leg;

a second web of resilient material extending between the second leg and the third leg; and a third web of resilient material extending between the third leg and the first leg.

4. The tee of claim 1, further comprising:

a first web of resilient material between the first ball support and the second ball support;

a second web of resilient material between the second ball support and the third ball support; and a third web of resilient material between the third ball support and the first ball support.

5. The tee of claim 1, further comprising a spike extending down from the hub through the terrain plane.

6. The tee of claim 1, further comprising a disk extending horizontally from the hub.

7. A tee for use supporting a golf ball, the tee comprising:

a spike for use penetrating turf having an end that extends to a spike length, supported by at least two angled legs that extend from a hub down to a level above a spike end;

a first ball support, a second ball support and a third ball support, extending upward from the hub, wherein each ball support is less than 80% the length of a golf-ball radius; and a disk extending horizontally from the hub.

8. The tee of claim 7, wherein the first ball support extends along an axis, the second ball support extends along a second axis, and the third ball support extends along a third axis, and each axis is at least 80 degrees angled from other axes of the other ball supports.

9. The tee of claim 7, wherein the at least two angled legs comprise a first leg having a first axis, a second leg having a second axis, and a third leg having a third axis.

10. The tee of claim 9, wherein at least the first axis and the second axis have an angle of at least 30 degrees between the first axis and the second axis.

* * * * *